US006338341B1

(12) United States Patent
Drews et al.

(10) Patent No.: US 6,338,341 B1
(45) Date of Patent: Jan. 15, 2002

(54) PROTECTIVE BREATHING MASK

(75) Inventors: Ralf Drews; Hartmut Kintzel, both of Lübeck (DE)

(73) Assignee: Dräger Sicherheitstechnik GmbH, Lübeck (DE)

( * ) Notice: Subject to any disclaimer, the term of this patent is extended or adjusted under 35 U.S.C. 154(b) by 0 days.

(21) Appl. No.: 09/435,604

(22) Filed: Nov. 8, 1999

(30) Foreign Application Priority Data

Nov. 6, 1998 (DE) ..... 198 51 322

(51) Int. Cl.[7] ..... A62B 18/02

(52) U.S. Cl. ..... 128/206.21; 128/205.27; 128/201.25; 128/206.28

(58) Field of Search ..... 128/201.23, 200.27, 128/201.18, 201.25, 207.28, 205.27, 206.21, 206.28

(56) References Cited

U.S. PATENT DOCUMENTS 3,968,793 A * 7/1976 Geissler
4,961,420 A * 10/1990 Cappa et al. ..... 128/207.12
5,653,225 A * 8/1997 Schegerin ..... 128/201.24
5,895,537 A * 4/1999 Campbell ..... 156/73.1
6,035,852 A * 3/2000 Hoftman ..... 128/206.26
6,085,748 A * 7/2000 Sword et al. ..... 128/206.23
6,155,253 A * 12/2000 Gamberini ..... 128/201.18
6,176,239 B1 * 1/2001 Grove et al. ..... 128/206.24

FOREIGN PATENT DOCUMENTS

EP 0329941 4/1993

* cited by examiner

*Primary Examiner*—John G. Weiss
*Assistant Examiner*—V. Srivastava
(74) *Attorney, Agent, or Firm*—Walter Ottesen

(57) ABSTRACT

A protective breathing mask has a connector housing unit having a connector housing for accommodating breathing mask components. The connector housing unit has a flange-like collar extending from the connector housing. The flange-like collar has a connecting rim. A mask body made of an elastomer has a profile-reinforced portion defining a cutout for the connector housing unit and the profile-reinforced portion is shaped to match the peripheral rim. A clamping ring is provided for fixedly securing the profile-reinforced portion at the connecting rim. The clamping ring has a slot for holding the profile-reinforced portion. The clamping ring is shaped to match the connecting rim of the flange-like collar and has a connecting surface for connecting the clamping ring to the collar at the connecting rim.

5 Claims, 1 Drawing Sheet

PROTECTIVE BREATHING MASK

FIELD OF THE INVENTION

The invention relates to a protective breathing mask having a connector housing for mask components, a mask body connectable to the connector housing and made of elastomeric material, a connecting surface extending about the periphery of the connector housing for a correspondingly configured cutout defined by a profile-reinforced portion of the mask body, and a connecting member for securing the profile-reinforced portion to the connecting surface.

BACKGROUND OF THE INVENTION

A protective breathing mask of the above-mentioned kind is disclosed in European patent publication 329 941 B1. The known protective breathing mask has a connector piece in which a breathing connector, an inhalation valve, and an exhalation valve are accommodated. The outer surface of the connector piece is configured as a connecting surface for a mask body made of a flexible material. In the region of the connecting surface of the connector, the mask body is reinforced by a profiled configuration so that the mask has a certain stability as to form during assembly. The profile-reinforced portion of the mask body defines a cutout and is fastened by a clamp to the connecting surface of the connector.

The known connection by a clamp can be realized only for oval or circular connector housings in which the clamp can be mounted in a plane. Because of this pregiven outer contour of the connector housing, however, there are only a few degrees of freedom available within the connector housing for the arrangement of the breathing valves and the breathing connector relative to one another so that an optimal positioning of these components is often not possible.

SUMMARY OF THE INVENTION

It is an object of the invention to improve a protective breathing mask of the above-mentioned kind such that the connection between the mask body and the connector housing can be realized in a simple manner without having to provide certain preferred geometric shapes at the connecting location.

The protective breathing mask of the invention includes: a connector housing unit; the connector housing unit including a connector housing adapted to receive breathing mask components therein; the connector housing unit including an annular flange-like collar extending outwardly from the connector housing; the flange-like collar having a connecting rim; a mask body having a profile-reinforced portion; the profile-reinforced portion being configured to correspond to the connecting rim; a clamping ring having a cutout for holding the profile-reinforced portion; the clamping ring being formed to correspond to the connecting rim and having a connecting surface in direct contact engagement with the connecting rim; the connecting rim and the connecting surface conjointly defining an interface; and, joining means for joining the clamping ring to the connecting rim in the region of the interface to trap and hold the profile-reinforced portion therebetween.

The advantage of the invention lies essentially in that a plurality of connecting geometries can be realized by the combination of the invention of a clamping ring, in which the profile-reinforced portion of the mask body to be connected to the connector housing unit is initially secured, and the subsequent connection of the clamping ring to the connecting rim disposed spaced from the connector housing. The connector housing unit with the connecting rim as well as the clamping ring configured to match the connecting rim can be manufactured as injection-molded parts without being restricted to certain preferred geometries. For fixing the mask body portion defining the cutout in the clamping ring, the clamping ring is provided with a slot-like recess into which the profile-reinforced portion of the mask body is inserted.

Alternatively, it is also possible to provide the slot-like recess at the connecting rim of the connector housing unit and to initially fix the profile-reinforced portion at the connecting rim of the connector housing unit. The clamping ring can be attached at the connector housing unit at the common connecting surface between the connecting rim of the connector housing unit and the clamping ring, for example, by a snap connection. The elements of this snap connection can be directly formed, as is known in the art, on the injection-molded parts without incurring additional cost.

It is especially advantageous to select the materials of the clamping ring and of the rim such that a welded or adhesive connection can be produced at the connecting surface. An especially advantageous welding method is the so-called ultrasound welding method, and especially suitable materials therefor are polypropylene, polyamide and PVC.

BRIEF DESCRIPTION OF THE DRAWING

The invention will now be described with reference to the single figure (FIG. 1) which shows a longitudinal section view of a detail of the mask body connected to the connector housing.

DESCRIPTION OF THE PREFERRED EMBODIMENTS OF THE INVENTION

Figure 1:
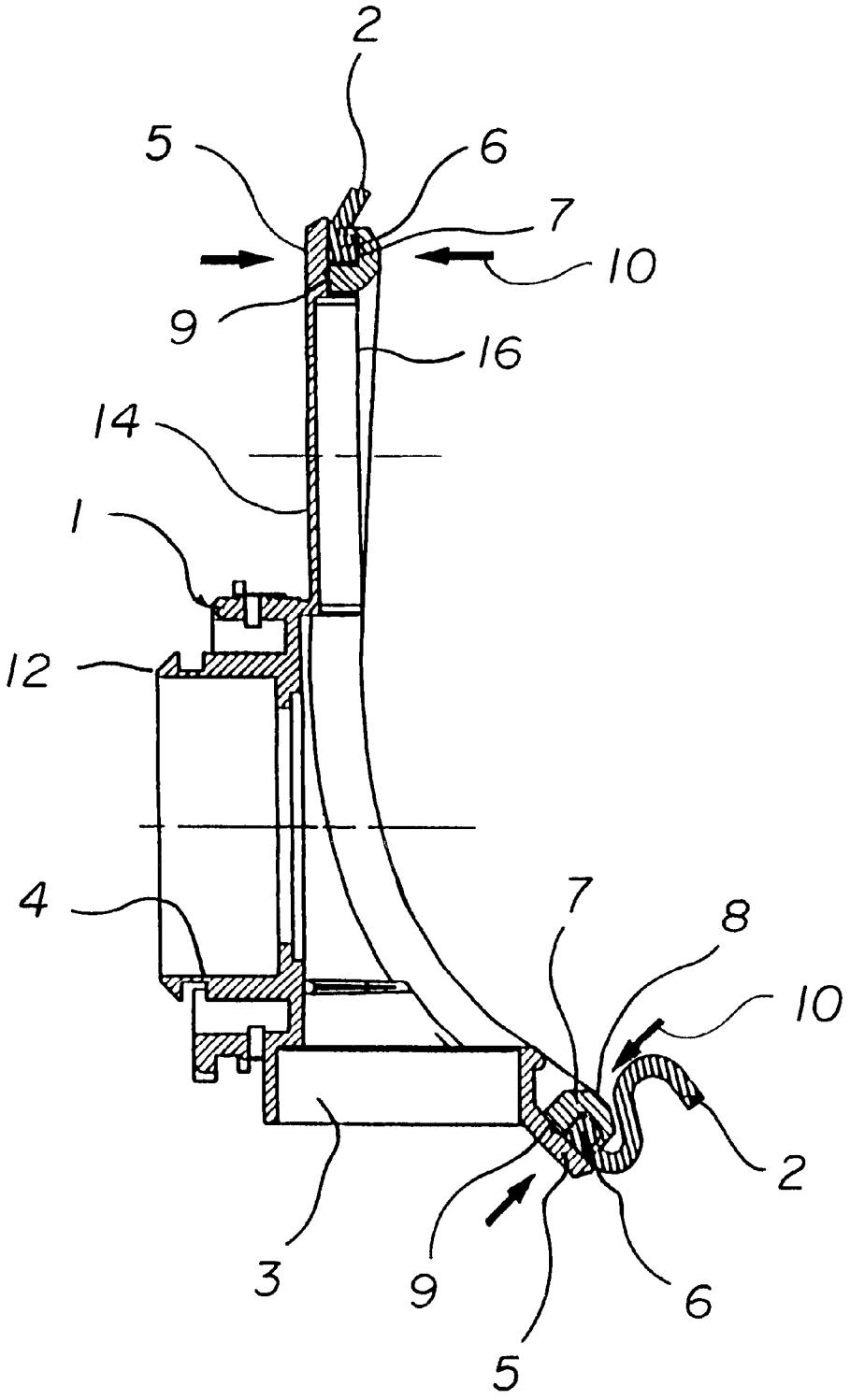

The connector housing unit 1 has a housing 12 having receptacle bores (3, 4) for an exhalation valve (not shown) and a breathing connector. For connecting the connector housing unit 1 to the mask body 2, the connector housing unit 1 is provided with a connecting rim 5 on a flange-like collar 14 projecting away from the connector housing 12. The flange-like collar is reinforced by ribs 16.

A profile-reinforced portion 6 of the mask body 2 is disposed in a slot 7 of a clamping ring 8. The clamping ring 8 has a connecting surface 9 in contact engagement with a surface of the connecting rim 5 of the connector housing unit. The connector housing unit 1 and the clamping ring 8 are of polyamide. The assembly of the clamping ring 8 and the connecting rim 5 of the connector housing unit 1 is carried out such that the profile-reinforced portion 6 is first inserted into the slot 7 of the clamping ring 8 and is pressed by a clamping tool (schematically represented by arrows 10) against the connecting rim 5. Material bonding at the interface conjointly defined by connecting surface 9 of the clamping ring and the surface of the connecting rim 5 is produced by ultrasound welding.

It is understood that the foregoing description is that of the preferred embodiments of the invention and that various changes and modifications may be made thereto without departing from the spirit and scope of the invention as defined in the appended claims.

What is claimed is:

1. A protective breathing mask comprising:

a connector housing unit;

said connector housing unit including a connector housing adapted to receive breathing mask components therein;

said connector housing unit including an annular flange-like collar extending outwardly from said connector housing;

said flange-like collar having a connecting rim;

a mask body having a profile-reinforced portion;

said profile-reinforced portion being configured to correspond to said connecting rim;

a clamping ring having a cutout for holding said profile-reinforced portion;

said clamping ring being formed to correspond to said connecting rim and having a connecting surface in direct contact engagement with said connecting rim;

said connecting rim and said connecting surface conjointly defining an interface; and, joining means for joining said clamping ring to said connecting rim in the region of said interface to trap and hold said profile-reinforced portion therebetween.

2. The protective breathing mask of claim 1, wherein said mask body is made of elastomeric material.

3. The protective breathing mask of claim 2, wherein:

said joining means being an adhesive connection at said interface for joining said clamping ring to said connecting rim; and, said clamping ring and said connecting rim being made of materials selected to realize said adhesive connection.

4. The protective breathing mask of claim 2, wherein:

said joining means being a weld connection at said interface for joining said clamping ring to said connecting rim; and, said clamping ring and said connecting rim being made of materials selected to realize said weld connection.

5. The protective breathing mask of claim 4, wherein said materials suitable for said weld connection are polypropylene, polyamide and PVC.

* * * * *